US006503180B1

(12) United States Patent
Plüschow et al.

(10) Patent No.: US 6,503,180 B1
(45) Date of Patent: Jan. 7, 2003

(54) DEVICE FOR TRANSFERRING A FOLDED BOX

(75) Inventors: Dieter Plüschow, Stutensee (DE); Bernd Hähnel, Stutensee (DE)

(73) Assignee: IWK Verpackungstechnik GmbH, Stutensee-Blankonloch (DE)

( * ) Notice: Subject to any disclaimer, the term of this patent is extended or adjusted under 35 U.S.C. 154(b) by 0 days.

(21) Appl. No.: 09/914,447

(22) PCT Filed: Mar. 1, 2000

(86) PCT No.: PCT/EP00/01714

§ 371 (c)(1),
(2), (4) Date: Aug. 28, 2001

(87) PCT Pub. No.: WO00/51811

PCT Pub. Date: Sep. 8, 2000

(30) Foreign Application Priority Data

Mar. 5, 1999 (DE) ..... 199 09 754

(51) Int. Cl.[7] ..... B31B 1/06

(52) U.S. Cl. ..... 493/51; 493/313; 493/315; 493/318; 493/309

(58) Field of Search ..... 493/51, 122, 123, 493/309, 313, 318, 315; 74/567, 569

(56) References Cited

U.S. PATENT DOCUMENTS 5,061,231 A 10/1991 Dietrich
5,067,937 A * 11/1991 Aschaber et al. ..... 493/310
5,603,599 A * 2/1997 Wesslen et al. ..... 294/64.2
5,662,577 A * 9/1997 Reuteler ..... 493/315
5,997,458 A * 12/1999 Guttinger et al. ..... 271/108
6,179,004 B1 * 1/2001 Davis, Jr. ..... 137/625.15
6,422,099 B1 * 7/2002 Sun ..... 74/55

FOREIGN PATENT DOCUMENTS

| | | |
|---|---|---|
| DE | 39 41 867 | 6/1991 |
| DE | 40 29 520 | 3/1992 |
| DE | 42 24 897 | 6/1993 |
| DE | 198 01 194 | 7/1999 |
| EP | 0 510 953 | 10/1992 |

* cited by examiner

*Primary Examiner*—Rinaldi I. Rada
*Assistant Examiner*—Gloria Weeks
(74) *Attorney, Agent, or Firm*—Paul Vincent

(57) ABSTRACT

A device for transferring a folded box from a magazine accommodating flat folded boxes to a circulating transport device thereby simultaneously erecting same, comprises a holding device transferring and carrying the folded box during transfer, and an erecting member. The holding device and the erecting member are rotatably disposed on a planetary part of a planetary gearing and are moved along a hypocycloid path having several turning points and intermediate curves. The planetary part is rotatably disposed on a planetary support which rotates about a stationary sun axis. Via a first gearing arrangement, the holding device is subjected to a superimposed, first correcting rotary motion defined along a first control curve and, via a second gearing arrangement, the erecting member is subjected to a superimposed, second correcting rotary motion defined along a second control curve. Both gearing arrangements are disposed substantially coaxially with respect to one another.

6 Claims, 5 Drawing Sheets

DEVICE FOR TRANSFERRING A FOLDED BOX

BACKGROUND OF THE INVENTION

The invention concerns a device for transferring a folded box from a magazine accommodating flat folded boxes to a circulating transport device while thereby simultaneously erecting same, comprising a holding device transferring and carrying the folded box during transfer, and an erecting member, wherein the holding device and the erecting member are rotatably disposed on a planetary part of a planetary gearing and are moved through a hypocycloid path having several turning points and intermediate curves, wherein the planetary part is rotatably disposed on a planetary support which rotates about a stationary sun axis.

A device of this type is used in packaging machines. Before introducing the product to be packaged, these machines must first erect the folded boxes, which are initially disposed in a magazine in flattened form, and introduce same into a transport device, which is usually a band or chain conveyor. Towards this end, each folded box is removed from the magazine by a holding device which is usually a suction device disposed on a circulating planetary part of a removal device travelling about a sun wheel, and is transported together with same along a hypocycloid path to the chain conveyor and disposed in a space defined between two carrier fingers. During movement along the hypocycloid path, an erecting member disposed on the planetary part is brought into abutment with the folded box thereby erecting it. It has turned out that use of a simple planetary gearing in the transferring device is insufficient to guarantee prolonged and proper transfer of the folded box to the chain conveyor. For this reason, attempts have been made to optimize the course of the hypocycloid path through e.g. cyclic reciprocating movement of the sun wheel or by adding a second sun wheel having a further planetary part, wherein the two sun wheels are adjustable relative to one another to thereby adjust the movements in a desired manner. In any event, the constructive effort is very high and the devices are consequently not only expensive but also susceptible to failure.

Conventionally, the holding device and the erecting member are disposed next to one another on the planetary part and are pivotable independently of one another. As a result, the different rotational motions of the holding device and of the erecting member as well as their mutual separation disadvantageously lead to relatively high dynamic loads acting on the planetary part. These loads produce irregular rotary motions, whose accommodation causes difficulties in structuring the planetary part, an increase in the amount of space required, and leads to the eccentric displacement of relatively large masses.

It is the underlying purpose of the invention to produce a device of the above-mentioned type which has a compact construction and which guarantees reliable transferring of the folded box to the transport device.

SUMMARY OF THE INVENTION

This object is achieved in a device of the above-mentioned type in that a first correcting rotary motion, defined by a first control curve, can be superimposed upon the holding device via a first gearing arrangement and a second correcting rotary motion, defined by a second control curve, can be superimposed upon the erecting member via a second gearing arrangement, wherein both gearing arrangements are disposed substantially coaxially with respect to one another.

In accordance with the invention, correcting rotary motions are defined by one independent control curve for each rotary motion of the holding device and of the erecting member, and are superimposed upon the respective rotary motion associated with rotation of the planetary part. This produces a corrected hypocycloid path which is optimally adjusted to the construction of the packaging machine.

To prevent the two gearing arrangements for the correcting rotary motion of the holding device and of the erecting member from producing large eccentric loads on the planetary part and thereby large imbalances during the rotary motion, the invention provides that, to the extent possible, the gearing arrangements are disposed coaxially with respect to each other. In this fashion, a transferring device can be produced which requires little space.

A preferred embodiment of the invention provides that the first gearing arrangement comprises a first correction shaft which indirectly engages the first control curve and which is rotated thereby and which drives, via a first gearing arrangement, a first drive shaft which is eccentrically disposed parallel thereto and which supports the holding device. The second gearing arrangement also comprises a second correction shaft which indirectly engages the second control curve and which is rotated thereby and which drives, via a second gearing arrangement, a second drive shaft which is eccentrically disposed parallel thereto and which bears the erecting member, wherein the two correction shafts and the two drive shafts are each coaxial with respect to one another. The coaxial arrangement of the drive shafts and of the correction shafts utilizes the construction space to an optimum degree and minimizes the eccentricities and associated additional dynamic loads of the transferring device.

The first correction shaft is preferably formed as a hollow shaft through which the second correction shaft penetrates. The second drive shaft may also be a hollow shaft through which the first drive shaft penetrates.

To change or adjust the correcting rotary motion if required, the sun axis is provided with a control disc which can preferably be replaced and in which the two control curves are formed. A further embodiment of the invention thereby provides that the two control curves are defined on opposing sides of the control disc to prevent mutual interference and to substantially free the course of the control curves.

Further details and features of the invention can be extracted from the following description of an embodiment with reference to the drawing.

DESCRIPTION OF THE PREFERRED EMBODIMENT

Figure 1:
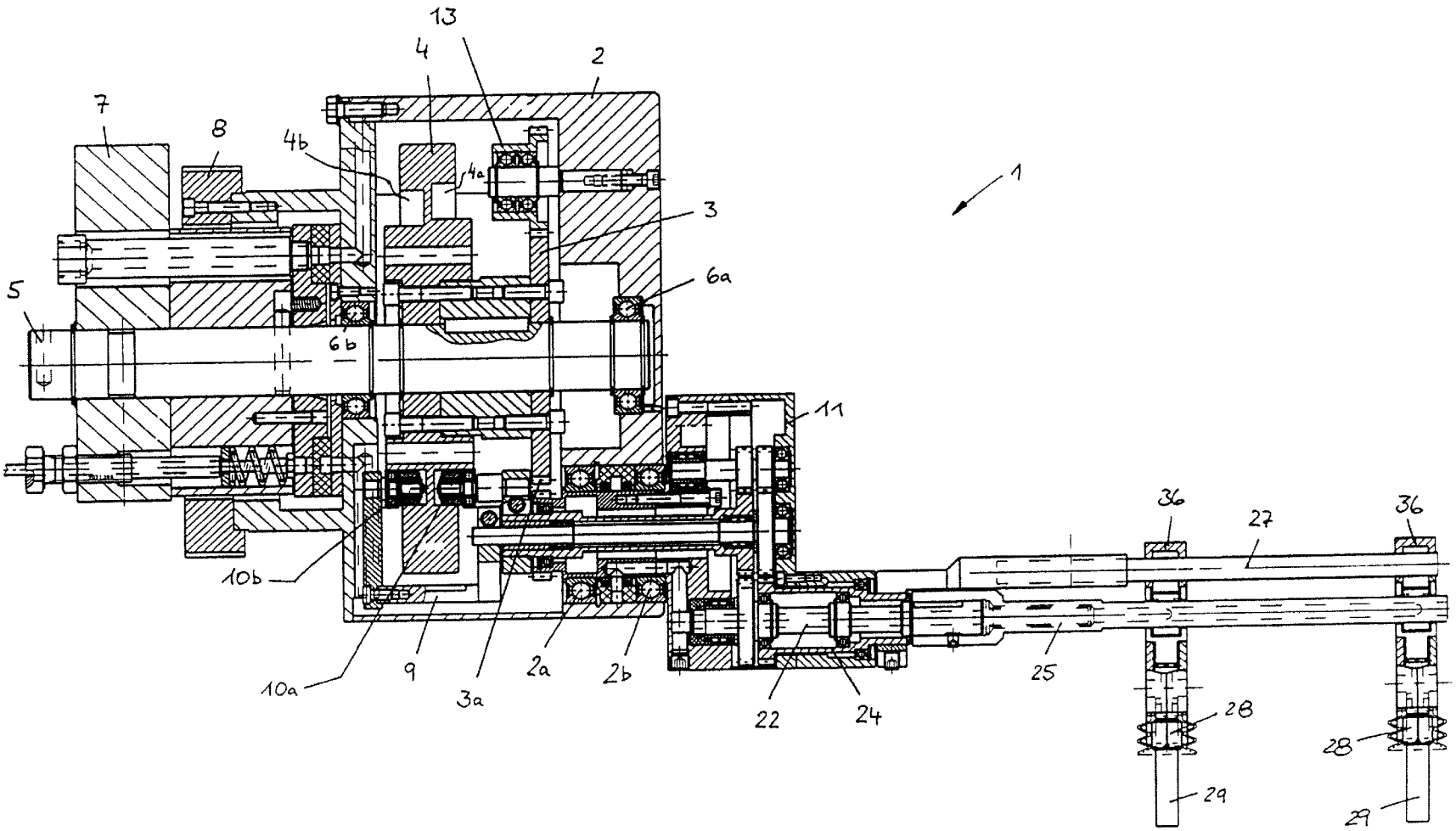
FIG. 1 shows a vertical section through a transferring device in accordance with the invention.
Figure 2:
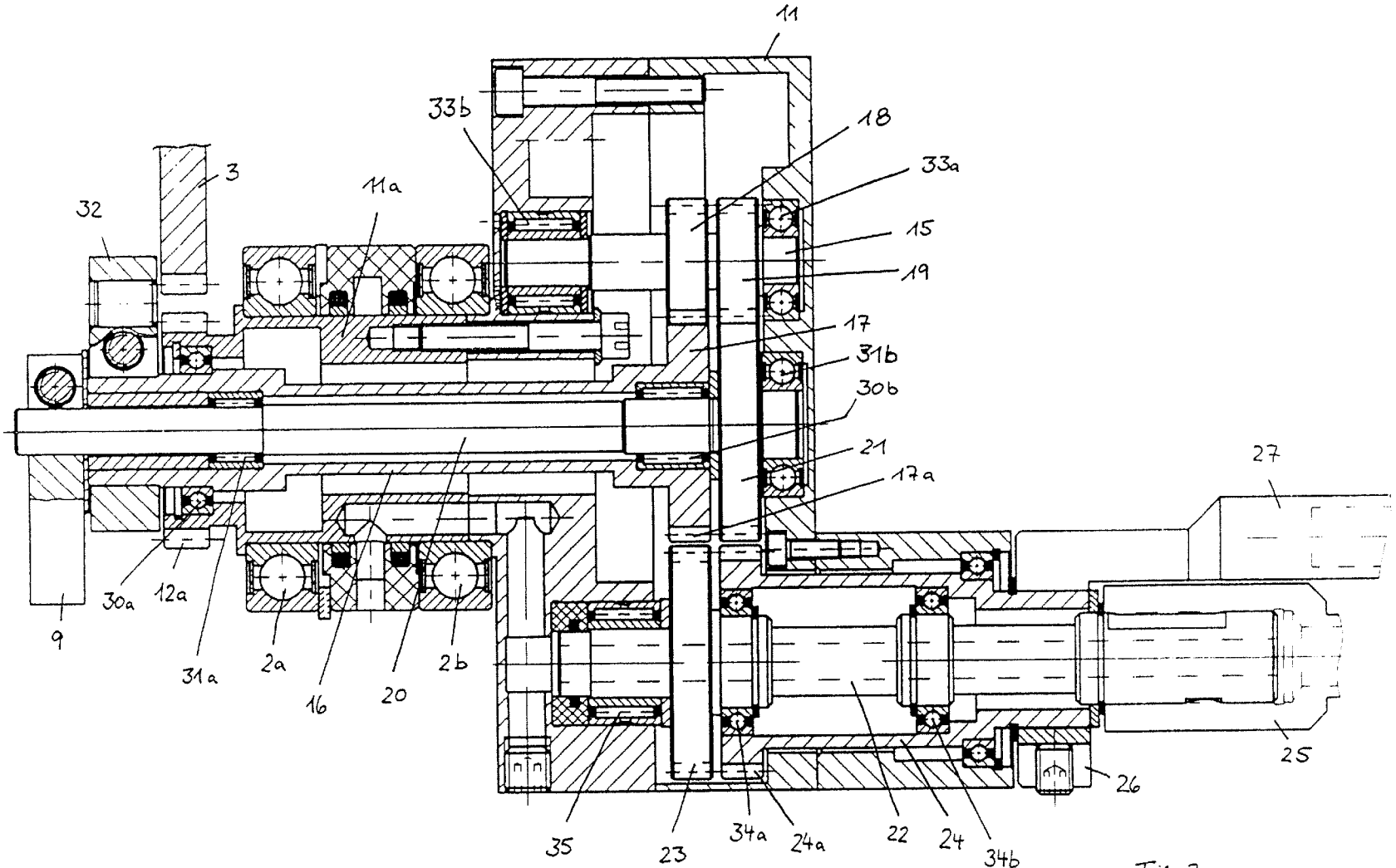
FIG. 2 shows an enlarged representation of the planetary part of the transferring device in accordance with FIG. 1.

FIGS. 1 and 2 show a transferring device 1 for a folded box having a stationary frame part 7 in which a sun axis 5 is fixed. A sun wheel 3 is fixedly mounted on the sun axis 5 and has a peripheral outer toothing 3*a* which engages with the toothing of an intermediate wheel 13. A control disc 4 is mounted on the sun axis 5 and has a first control curve 4*a* on its side facing the sun wheel 3 as well as a second control curve 4*b* on its side facing away from the sun wheel 3, both of which are formed as continuous grooves. A planetary support 2 is rotatably disposed on the sun axis 5 via bearings 6*a,* 6*b*. The planetary support 2 bears the intermediate wheel 13 such that it can be rotated, surrounds the sun wheel 3 like a casing, and carries a drive wheel 8 by means of which the planetary support 2 can be rotated about the sun axis 5.

A sleeve-like projection 11*a* of a planetary part 11 is rotatably disposed in the planetary support 2 via two axially separated bearings 2*a* and 2*b*. As shown, in particular in FIG. 2, the sleeve-like projection 11*a* has a toothing 12*a* on its free end facing the sun wheel 3, which engages and runs along the outer toothing 3*a* of the sun wheel 3 via the intermediate wheel 13.

A first correction shaft 16 is rotatably disposed in the sleeve-like projection 11*a* and in the planetary part 11 via two axially separated bearings 30*a* and 30*b*. The first correction shaft 16 is a hollow shaft and has a lever 32 on its rear end facing the sun wheel 3 in which a first curve roller is rotatably disposed which runs, with close tolerance, in the first control curve 4*a* of the control disc 4. The front end of the first correction shaft 16, facing away from the sun wheel 3, is provided with a first drive gear 17 which constitutes a sun wheel relative to the planetary support 11.

A second correction shaft 20 is rotatably disposed, via axially separated bearings 31*a,* 31*b,* in the first correction shaft 16 and bears a yoke-shaped lever 9 passing by the control disc 4, in which a second curve roller 10*b* is rotatably disposed to run, with close. tolerance, in the second control curve 4*b* formed on the rear side of the control disc 4. A second drive gearing 21 is disposed on the front end of the second correction shaft 20 facing away from the sun wheel 3 which also represents a sun wheel relative to the planetary support 11 and which is disposed directly next to the first drive gearing 17 of the first correction shaft 16.

An intermediate shaft 15 is rotatably disposed in the planetary part 11 via axially separated bearings 33*a,* 33*b* and is parallel to the sleeve-like projection 11*a* and the first or second correction shaft 16, 20, however displaced relative thereto. The intermediate shaft 15 bears a first intermediate gearing 18 which engages with the first drive gearing 17 of the first correction shaft 16 as well as a second intermediate gearing 19 which engages with the second drive gearing 21 of the second correction shaft 20. The two intermediate gearings 18 and 19 can be rotated relative to one another.

A second drive shaft 24 formed as hollow shaft is rotatably disposed in the planetary part 11 and has a peripheral toothing 24*a* on its one axial end which engages with the second intermediate gearing 19. This is not shown in FIGS. 1 and 2 since the intermediate shaft 15 with front gearing 14, the first intermediate gearing 18 and the second intermediate gearing 19 are shown rotated through approximately 180° for reasons of clarity. The opposing axial end of the second drive shaft 24 bears, via a holder 26, a driving rod 27 which extends in an axially offset fashion and drives, via erector gearings 36, erector members 29 in the form of erector levers (schematically shown in FIG. 1).

A first drive shaft 22 is rotatably disposed coaxially within the second drive shaft 24 via axially separated bearings 34*a* and 34*b* and is borne in the planetary support 11 via a bearing 35. The first drive shaft 22 bears a drive gearing 23 which engages with the first intermediate gearing 18 of the intermediate shaft 15. This engagement is also not visible in FIGS. 1 and 2 since the representation is rotated, as described above. The first drive shaft 22 exits the second drive shaft 24 at its opposite end in the region of the holder 26 and bears a holding arm 25 in axial extension which extends substantially parallel to the drive bar 27 and bears several holding devices 28, in the form of suction devices, for receiving a folded box.

When the drive wheel 8 is turned, the planetary support 2 is rotated about the sun axis 5 wherein the gearing 12*a* of the sleeve-like projection 11*a* travels, via the intermediate gearing 13, along the outer gearing 3*a* of the sun wheel 3 thereby rotating the sleeve-like projection 11*a* and the planetary part 11. This rotates the intermediate shaft 15 with the first intermediate gearing 18 and the second intermediate gearing 19. The first drive shaft 22 is rotated with a suitable gear ratio through engagement of the first intermediate gearing 18 with the drive gearing 23 of this first drive shaft 22, thereby pivoting the holding arm 25 with the suction devices 28. The second drive shaft 24 is rotated with a suitable gear ratio through engagement of the second intermediate gearing 19 with the gearing 24*a* of this second drive shaft 24, thereby pivoting the drive rod 27 of the erecting members 29.

These rotary motions are overlapped with correcting rotary motions extracted from the first and second control curve 4*a* and 4*b* of the control disc 4. When the planetary support 2 turns about the sun axis 5, the first curve roller 10*a* runs along the first control curve 4*a,* thereby pivoting the lever 32 and the first correcting shaft 16 and this pivoting motion is transferred via the first drive gearing 17 to the first intermediate gearing and from same, via the drive gearing 23, to the first drive shaft 22 and thus to the holding arm 25 of the suction devices 28. The second curve roller 10*b* runs correspondingly along the second control curve 4*b* which produces a pivoting motion of the second correction shaft 20 via the lever 9 and thus of the second drive gearing 21 which is transferred via the second intermediate gearing 19 and the toothing of the second drive shaft 24 to the drive rod 27 of the erecting members 29.

Figure 3:
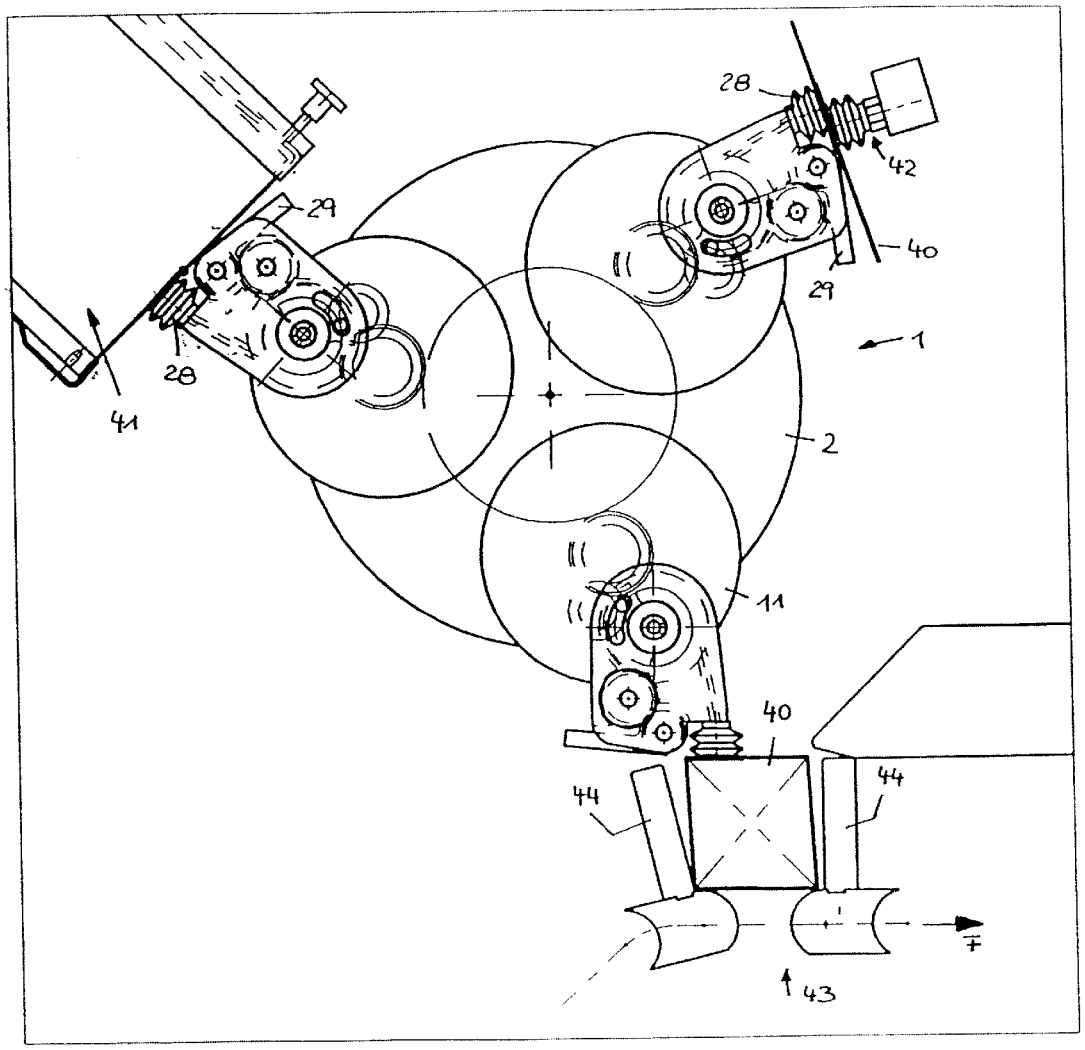
FIG. 3 shows first individual phases of transferring and erecting of a folded box.
Figure 5:
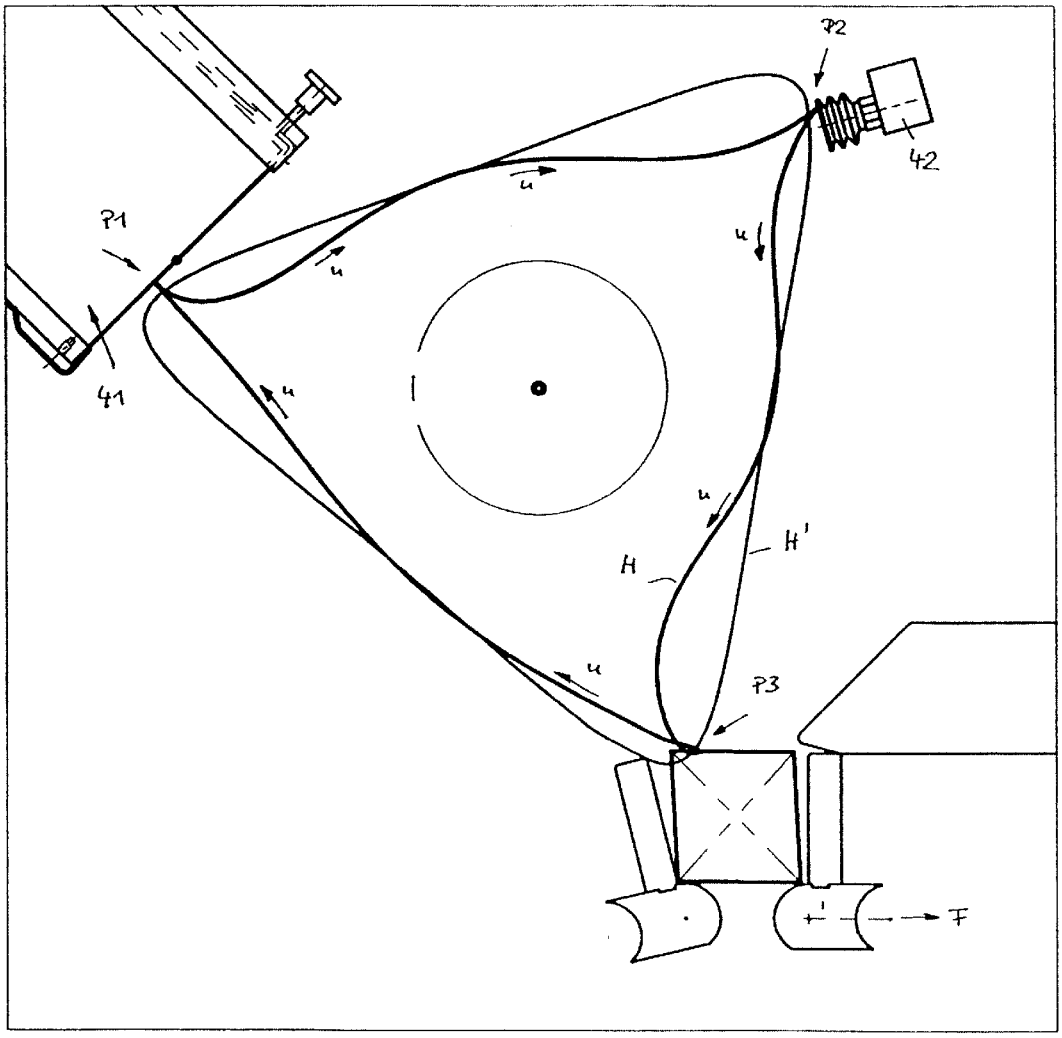
FIG. 5 shows the course of the corrected hypocycloid path.

FIG. 3 shows the basic arrangement of the transferring device within a packaging machine. The packaging machine comprises a circulating chain conveyor 43 having several carrier fingers 44 disposed at a separation from one another and between which gaps 45 are formed into each of which one folded box 40 can be inserted. The chain conveyor 43 is supplied with folded boxes from above, wherein its supply direction F extends substantially horizontally. The transferring device 1 is disposed above the chain conveyor 43 close to its turning point. FIG. 5 shows the hypocycloid path H, centered on the sun axis 5, for the abutment surface of the suction devices 28 which results during drive of the planetary support 2 and passage through the first control curve 4*a*. The hypocycloid path H has three turning points P1, P2, P3 which lie at the corner points of an approximately equilateral triangle. The sense of rotation along the hypocycloid path H is substantially clock-wise as indicated by the arrows U. Since the sense of rotation of the chain conveyor 43 also extends in a clock-wise direction, the movements in the facing neighboring sections are substantially opposite. FIG. 5 also illustrates a cycloid path H which would result without the correcting rotary motions produced by the control curves 4*a* and 4*b*.

Figure 4:
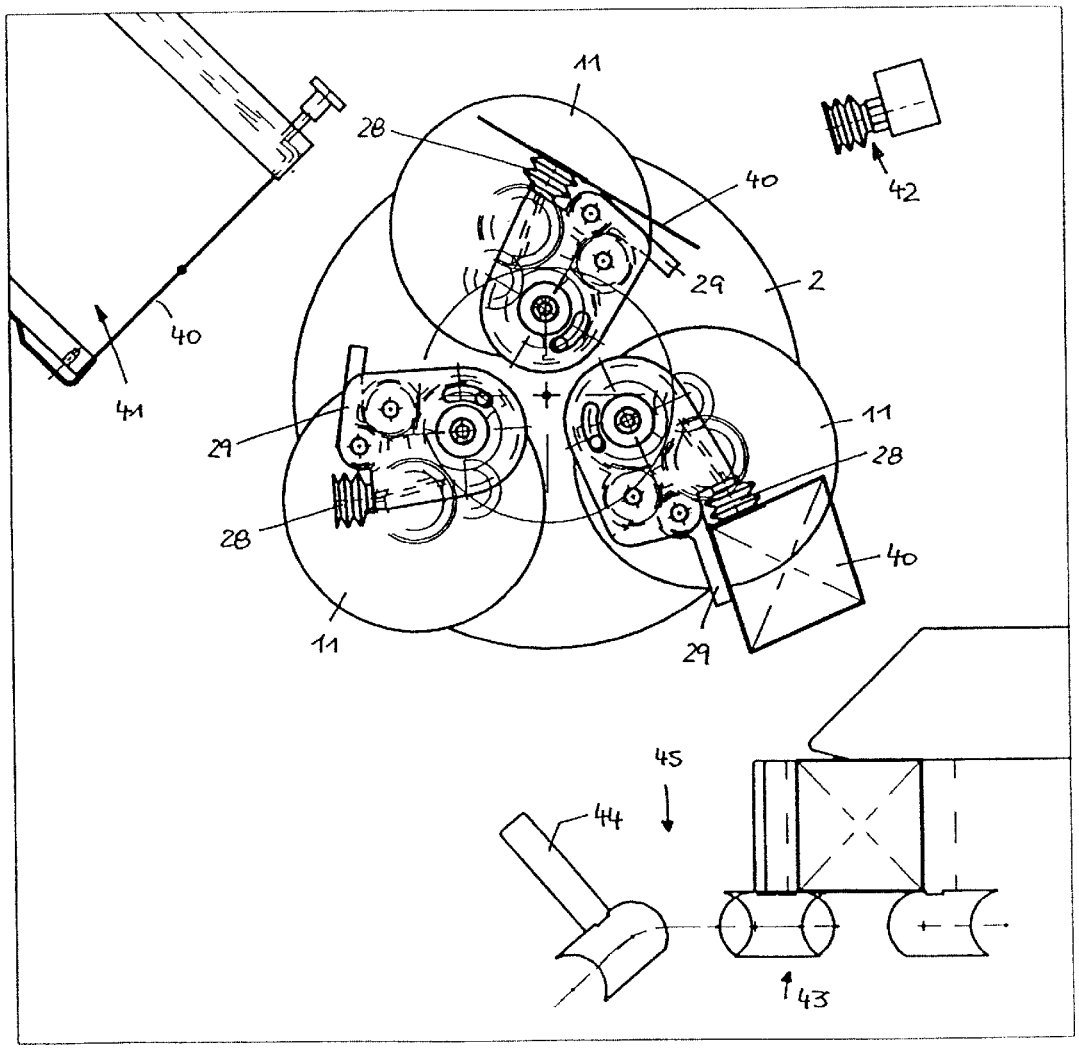
FIG. 4 shows second individual phases of transferring and erecting of a folded box.

The left upper part of FIG. 3 shows the state of the suction devices 28 at the first turning point P1 at which a magazine 41 is disposed containing the flat folded boxes 40. The suction devices 28 are activated in this state and grasp the lowest folded box 40 from the magazine 41. During further motion of the planetary support 2 (FIG. 4), the abutment surface of the suction devices 28 is moved together with the folded box 40 along the first curve of the hypocycloid path H in the direction of the second turning point P2 at which an erecting suction device 42 is disposed. When the second turning point P2 has been reached (FIG. 3, top right), the folded box 40 is brought into abutment with the erecting suction device 42 thereby slightly pulling the folded box 40 apart during further motion of the suction devices 28.

During movement along the second curve between the second turning point P2 and the third turning point P3 where the folded box is handed over to the chain conveyor 43, the suction devices 28 are additionally pivoted by 45° in the clockwise direction (FIGS. 3 and 4) such that, when they reach the third turning point P3, their abutment surface is substantially horizontal and they are disposed parallel to the transport direction F of the chain conveyor 43 (FIG. 3, lower representation). During motion between the second turning point P2 and the third turning point P3, the erecting member 29 which forms an erection abutment, is brought into abutment with the folded box 40 thereby completely erecting same.

The additional pivoting motion of the suction devices 28 permits insertion of the folded box 40 from above into the gap 45 of the transport device 43 formed between two carrier fingers 44, wherein the adjustment of the hypocycloid path H relative to the transport device 43 has the advantage that the suction devices 28 and the folded box 40 have a component of motion in the supply direction when approaching the third turning point P3 where the folded box is transferred (FIG. 5). After delivery of the folded box 40 to the transport device 43, the suction devices 28 return into the original position (FIG. 3, upper left representation) whereupon the cycle is repeated.

We claim:

1. A device for transferring a folded box from a magazine accommodating flat folded boxes to a circulating transport device, thereby simultaneously erecting the folded box, the transfer device comprising:

a holding device for transferring and holding the folded box during transfer thereof;

an erecting member for erecting the folded box;

means defining a stationary sun axis;

a planetary support disposed for rotation about said stationary sun axis;

a planetary part disposed for rotation on said planetary support, said planetary part bearing said holding device and said erecting member for rotation with respect to said planetary part to move said holding device and said erecting member along a hypercycloid path having several turning points and intermediate curves;

means for superimposing a first correcting rotary motion on said holding device, said first correcting rotary motion means having means defining a first control curve, disposed external to said planetary part, and a first gearing arrangement disposed between and communicating with said first control curve and said holding device; and means for superimposing a second correcting rotary motion on said erecting member, said second correcting rotary motion means having means defining a second control curve disposed external to said planetary part and a second gearing arrangement disposed between and communicating with said second control curve and said erecting member, wherein said first gearing arrangement and said second gearing arrangement are disposed substantially coaxially with respect to each other.

2. The device of claim 1, wherein said first gearing arrangement comprises a first correction shaft which directly follows said first control curve for rotation thereby and which drives, via a first gearing mechanism, a first drive shaft which is disposed eccentrically and parallel to said first correction shaft, said first drive shaft supporting said holding device, and wherein said second gearing arrangement comprises a second correction shaft which directly follows said second control curve for rotation thereby and which drives, via a second gearing mechanism, a second drive shaft which is disposed eccentrically and parallel to said second correction shaft and which bears said erecting member, wherein said first correction shafts extends coaxially with respect to said second correction shaft and wherein said first drive shaft extends coaxially with respect to said second drive shaft.

3. The device of claim 2, wherein said first correction shaft is a hollow shaft through which said second correction shaft passes.

4. The device of claim 2, wherein said second drive shaft is a hollow shaft through which said first drive shaft passes.

5. The device of claim 1, wherein said first control curve and said second control curve are defined by a control disc disposed on said sun axis.

6. The device of claim 5, wherein said first control curve and said second control curve are defined on opposite sides of said control disc.

* * * * *